US005277520A

United States Patent [19]

Travis

[11] Patent Number: 5,277,520

[45] Date of Patent: Jan. 11, 1994

[54] GRID COMPOSITE FOR BACKFILL BARRIERS AND WASTE APPLICATIONS

[75] Inventor: Brian Travis, Hampton, Ga.

[73] Assignee: The Tensar Corporation, Morrow, Ga.

[21] Appl. No.: 856,401

[22] Filed: Mar. 23, 1992

Related U.S. Application Data

[63] Continuation-in-part of Ser. No. 803,444, Dec. 6, 1991, Pat. No. 5,199,825.

[51] Int. Cl.[5] ..... E02D 15/00; B09B 5/00; E21D 19/00

[52] U.S. Cl. ..... 405/128; 405/258; 405/267; 405/288; 405/302.3

[58] Field of Search ..... 405/36, 50, 128, 129, 405/132, 258, 267, 288, 302.3

[56] References Cited

U.S. PATENT DOCUMENTS

| | | | |
|---|---|---|---|
| 2,919,467 | 1/1960 | Mercer . | |
| 3,386,876 | 6/1968 | Wyckoff . | |
| 3,697,347 | 10/1972 | Lehmann . | |
| 4,768,897 | 9/1988 | Nussbaumer et al. | 405/128 |
| 4,770,564 | 9/1988 | Dison | 405/288 |
| 4,815,892 | 3/1989 | Martin | 405/50 X |
| 4,946,310 | 8/1990 | Wunderatzke | 405/128 |
| 4,988,235 | 1/1991 | Hurley | 405/50 |
| 5,096,335 | 3/1992 | Anderson et al. | 405/288 |
| 5,152,633 | 10/1992 | Mercer et al. . | |

FOREIGN PATENT DOCUMENTS 2002686 2/1979 United Kingdom .

OTHER PUBLICATIONS

Coal—Feb., 1990.
Longwall Mining—pp. 14–19.
Underground Mining Systems and Equipment—pp. 12–74 through 12–95.

*Primary Examiner*—David H. Corbin
*Attorney, Agent, or Firm*—Jacobson, Price, Holman & Stern

[57] ABSTRACT

A grid composite for protecting men and longwall mining equipment during longwall shield recovery includes a regular polymer geogrid structure formed by biaxially drawing a continuous sheet of select polypropylene material which is heat bonded to a polyester fabric. The grid composite is secured over caving shields of longwall mining equipment during a longwall mining operation. The polymer grid composite is ideal for waste containment structures, backfill barriers, and silt barriers in construction and mining applications. In waste containment and backfill barriers, the grid composite is used to form a containment structure. It principle function is to contain waste material usually consisting of a liquid with some percentage of solids.

17 Claims, 9 Drawing Sheets

GRID COMPOSITE FOR BACKFILL BARRIERS AND WASTE APPLICATIONS

CROSS REFERENCE TO RELATED APPLICATION

This application is related to U.S. patent application Ser. No. 07/675,616, filed Mar. 27, 1991, for a POLYMER GRID FOR SUPPLEMENTAL ROOF AND RIB SUPPORT OF COMBUSTIBLE UNDERGROUND OPENINGS now U.S. Pat. No. 5,096,335, and is a continuation-in-part application of U.S. patent application Ser. No. 07/503,444, filed Dec. 6, 1991, now U.S. Pat. No. 5,199,825.

FIELD OF THE INVENTION

This invention relates to a high strength, lightweight polymer grid laminated with a material consisting of a non-woven polyester. It is utilized in underground coal and trona mines in the longwall recovery phase during movement of longwall mining system equipment. It can also be applied as a supplemental roof and rib control product in underground "non-gassy" mines.

BACKGROUND OF THE INVENTION

The recent development of polymer grids for the underground coal mining industry has created new alternatives for supplemental ground control practices. The grids utilize strong, lightweight polymers, usually special grades of polypropylene. High tensile strengths and resulting load support characteristics are achieved by molecular orientation of these polymers in the manufacturing process.

One of the most important applications of polymer grids as supplemental ground control is in longwall shield recovery. When shields are moved from one face to another, the determining factor in the success of the recovery is the ground control provided by roof support structures along the old face. Whereas primary support is usually provided by roof bolts and cables which run the full width of the panel, supplemental support is often provided by metallic meshes of welded wire or chain-link fence. Lightweight, high-strength polymer grids may replace these heavy, cumbersome metallic meshes, giving the operation increased productivity by decreasing installation time and reducing injury downtime.

However, use of polymer grids immediately over the shields during longwall shield recovery has produced potential dangers due to penetration through the polymer grid by large pieces of shale and sandstone of the gob, cutting through the polymer grid. Shield recovery is thereby hampered and mine workers are placed in danger.

SUMMARY OF THE INVENTION

By the present invention, a polymer grid is connected to a grid composite consisting of a polymer grid and a geotextile to provide a longwall screening package for use during longwall shield recovery. The grid composite is formed by use of a polymer grid which is typically heat bonded to an 8.0 oz./yd.$^2$, 100% continuous filament polyester, non-woven needlepunched engineering fabric. The engineering fabric or geotextile is bonded to the polymer grid using an open flame heat source or using a heated roll as a heat source.

During longwall mining, a first roll of polymer grid is attached, by chain, to the shearer and pulled onto the face. When the shearer has advanced 200 feet, a second roll is attached to the tail of the first roll and the shearer is advanced another 200 feet. This is done until the rolls are laying end to end the entire length of the face.

A spool of 9/16 inch or ¾ inch wire rope is placed on a spool stand in each successive crosscut. Then the wire rope is attached onto the shearer and pulled to the tailgate allowing it to run on the toes of the shields. Then the wire rope is unhooked from the shearer and a loop is made in both ends using three Crosby clamps. These loops are then hooked onto a roof bolt in the head-gate and tailgate and tensioned with a come-a-long.

The leading edge of the polymer grid is then fastened to the rope (dinged). The seams between the 200 foot rolls are also fastened. Once the rope and seams are dinged, the rope is placed under the canopy tips. The shields can then be lowered and advanced and the remainder of the roll is hung under the canopy tip.

During approximately the last thirty feet of a longwall mining operation, bolts are installed, at an angle, where the roof and rib meet. This usually requires ten to twelve roof bolts with plates and turnbuckles. These are spaced 30 inches apart or the width of cut of the shearer of the longwall mining system equipment. Approximately four inches of bolt are left exposed and installed at various spaced locations.

A full face pass is made and the procedure of installation of the polymer grid and grid composite is performed until the stopping point of the shearer is reached. The shields of the longwall mining system are now encompassed by the grid composite as held by the wire ropes on 30 inch centers which run the length of the face. The previous problem of cutting through only polymer grid protection is prevented by falling debris initially contacting the geotextile of the grid composite as reinforced below by polymer grid of the grid composite which is supported by the wire ropes.

The remaining gap between the canopy tips and the coal face is then bolted and planked. Longwall equipment recovery can then begin.

Typically, the polymer grid and the grid composite are available in 13 foot and 200 foot roll dimensions. The final width of polymer grid is joined together with an appropriate width of grid composite on the surface to eliminate most of the time consuming fastening (dinging) underground on the longwall face.

Rolls of grid composite are laid out side by side with a two foot overlap at the lateral seams. The seams are then joined by means of wire or plastic tie. It is recommended to use a four inch spacing on the fasteners down the length of the seams. The number of mats required depends on the width of the longwall face. The mats are rolled up and are then ready for transport underground. Typically they are folded and placed on supply cars and stored in the headgate or tailgate.

The grid composite includes a regular polymer geogrid structure formed by biaxially drawing a continuous sheet of select polypropylene material which is heat bonded to a polyester fabric.

The polymer geogrid of the grid composite shall typically conform to the following property requirements:

| PROPERTY | TEST METHOD | VALUE |
|---|---|---|
| Material | | |
| o copolymer | ASTM D 4101 | 97% (min) |

-continued

| PROPERTY | TEST METHOD | VALUE |
|---|---|---|
| polypropylene | Group 2/Class 1/Grade 1 | |
| o colorant and UV inhibitor | ASTM 4218 | 2.0% (min) |
| Interlock | | |
| o aperture size[1] | I.D. Calipered[2] | |
| @ MD | | 1.8 in. (nom) |
| @ CMD | | 2.5 in. (nom) |
| o open area | COE Method[3] | 75% (min) |
| o thickness | ASTM D 1777-64 | |
| @ ribs | | 0.07 in. (nom) |
| @ junctions | | 0.20 in. (nom) |
| Reinforcement | | |
| o flexural rigidity | ASTM D1388-64[4] | |
| MD | | 600,000 mg-cm (min) |
| CMD | | 800,000 mg-cm (min) |
| o tensile modulus | GRI GG1-87[5] | |
| MD | | 20,000 lb/ft (min) |
| CMD | | 21,000 lb/ft (min) |
| o junction strength | GRI GG2-87[6] | |
| MD | | 1350 lb/ft (min) |
| CMD | | 1350 lb/ft (min) |
| o junction efficiency | GRI GG2-87[6] | 90% (min) |
| The geotextile of the grid composite typically conforms to the following property requirements: | | |
| o Grab tensile strength | ASTM D1682 | 285/250 lbs |
| o EOS | ASTM D422 | 70 US Std Sv Sz |
| o Weight | ASTM D1910 | 8.0 oz/sy |
| The grid composite shall typically conform to the following property requirements: | | |
| o roll length | | 200 ft |
| o roll width | | 10 & 12 ft |
| o roll weight | | 210 & 260 lb |

[1]MD (machine direction) dimension is along roll length. CMD (cross machine direction) dimension is across roll width.
[2]Maximum inside dimension in each principal direction measured by calipers.
[3]Percent open area measured without magnification by Corps of Engineers method as specific in CW 02215 Civil Works Construction Guide, November 1977.
[4]ASTM D 1388-64 modified to account for wide specimen testing as described in Tensar test method TTM-5.0 "Stiffness of Geosynthetics".
[5]Secant modulus at 2% elongation measured by Geosynthetic Research Institute test method GG1-87 "Geogrid Tensile Strength". No offset allowances are made in calculating secant modules.
[6]Geogrid junction strength and junction efficiency measured by Geosynthetic Research Institute test method GG2-87 "Geogrid Junction Strength".

The polymer grid composite of the present invention is also ideal for use in a wide range of applications in the mining, industrial and construction markets. An important application of the polymer grid composite is in waste and containment applications. The polymer grid composite may be used in the mining industry, for use as a containment structure to contain and dewater waste by-products of the various types of processes utilized by the mining industry.

By the present invention, a grid composite consisting of a polymer grid and a geotextile is used to provide a containment structure in waste related applications. The grid composite is formed by use of a polymer grid which is typically heat bonded to a 100% continuous filament polyester, non-woven needle-punched engineering fabric. The fabric may consist of various weights and types of geotextile or engineering fabric. Its primary purpose is to act as a filter medium which will allow water to pass through while containing solids within the containment structure. The fabric is bonded to the polymer grid using an open flame heat source of a heated roll as a heat source.

The polymer grid composite is ideal for waste containment structures, backfill barriers, and silt barriers in construction and mining applications. In waste containment and backfill barriers, the grid composite is used to form a containment structure. It principle function is to contain waste material usually consisting of a liquid with some percentage of solids.

The polymer grid is utilized to provide the strength required for the structure while the geo-fabric "filters" the liquids involved. Typically, the containment structure is constructed utilizing the grid composite as the walls of the structure. The waste or backfill material is then pumped into the structure. Various pH adjusting material may be added or the material may be pretreated to aid in the flocculation of solids which would aid differential settling of the solids.

Due to the physical nature of the grid composite, the solids are contained within the waste containment structure or backfill barrier and the liquid is allowed to decant or pass through the fabric utilized. The liquid can then be disposed of or treated as required.

The structure typically utilizes wire ropes to provide additional tensile strength to the structure. These wire ropes are spaced at various intervals throughout the structure as required in the design of the structure. The wire ropes are attached to the grid composite by a wire or nylon tie to reinforce the grid composite walls. The spacing and size of these wire ropes depends on the anticipated hydraulic pressure within the backfill barrier or waste containment structure.

The grid composite, when utilized as a silt barrier at construction sites by anchoring to the ground, performs in exactly the same manner. It is utilized in an open trench to prevent silts or other small particles from washing onto streets or in some way contaminating adjacent properties.

The grid composite includes a regular polymer geogrid structure formed by biaxially drawing a continuous sheet of select polypropylene material which is heat bonded to a polyester fabric. The polymer geogrid of the grid composite typically conforms to the property requirements outlined above, plus the following property requirements:

| PROPERTY MATERIAL | TEST METHOD | VALUE |
|---|---|---|
| Vertical Water Flow at 2" head | ASTM D4491 | 135 gpm/ft$^2$ |
| Coefficient of Permeability, k | ASTM D4491 | .55 cm/sec |
| AOS (Mod. to 10 min.) | ASTM D4751 | 70/120 Sieve Size |

It is an object of the present invention to provide a grid composite including a polymer grid and a geotextile for use as a containment structure to contain a body of water and to filter water passing through the grid composite from the containment structure.

It is another object of the present invention to provide a grid composite including a polymer grid and a geotextile for use as a containment structure to contain a body of water and to filter water passing through the polymer grid composite from the containment structure where waste is being contained.

It is another object of the present invention to provide a grid composite including a polymer grid and a geotextile for use as a containment structure to contain a body of water and to filter water passing through the polymer grid composite from the containment structure where the grid composite is used as a silt barrier at a construction site.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
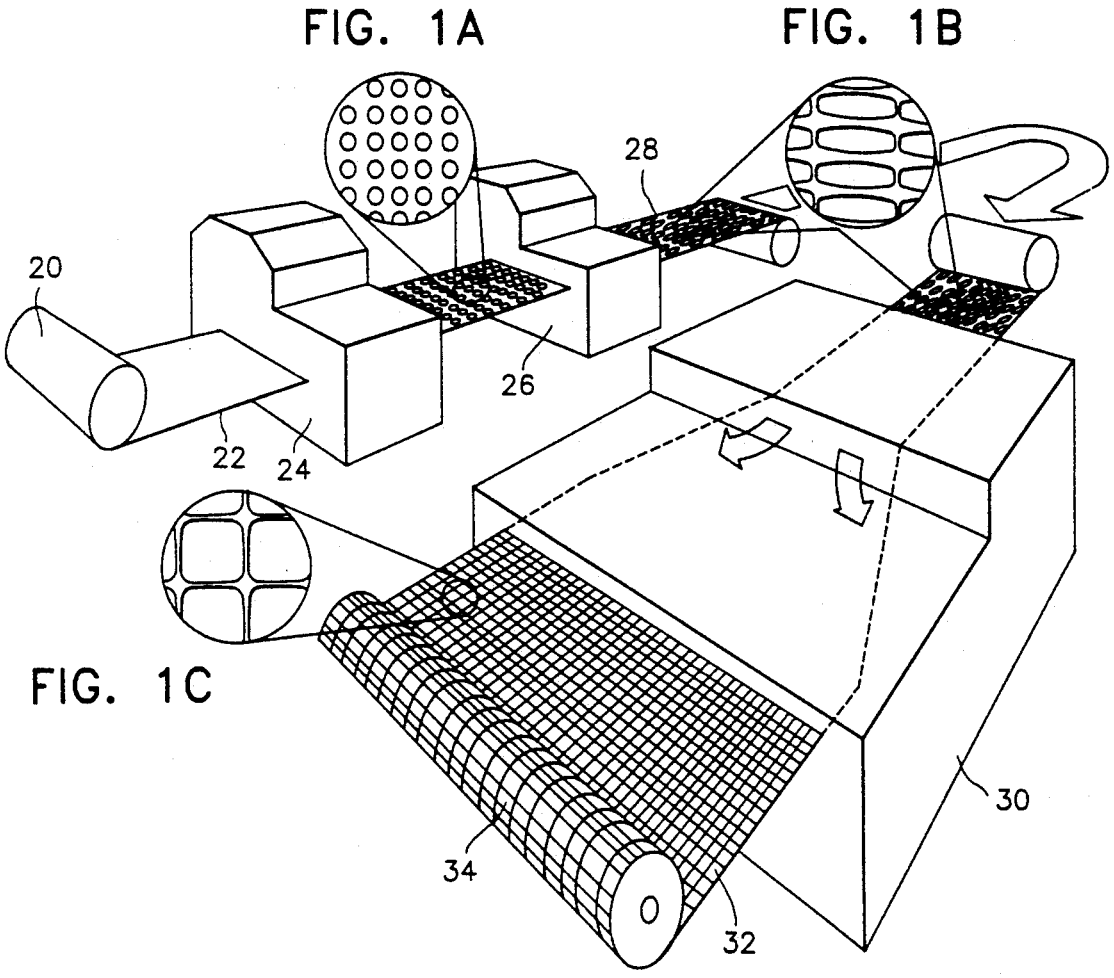
FIG. 1 is a schematic flowchart for formation of a polymer geogrid.

In describing a preferred embodiment of the invention illustrated in the drawings, specific terminology will be resorted to for the sake in clarity. However, the invention is not intended to be limited to the specific terms so selected, and it is to be understood that each specific term includes all technical equivalents which operate in a similar manner to accomplish a similar purpose.

Production of the grid composite for underground mining applications is accomplished in a four stage manufacturing process as schematically shown in FIG. 1:

I. SHEET EXTRUSION

A multi-component blending system allows for precise control of the raw material additives mix. This on-line blender feeds directly to an extruder, which compresses and melts plastic pellets, and then pumps the molten extrudate. A gear pump and a melt mixer are included in the extrusion system, to provide for a very accurate, consistent flow of a homogeneous melt. At the end of the extruder is a sheet die, which evenly distributes the melt flow across the desired sheet width.

The sheetline portion of the process accepts the molten sheet, cools it slowly and uniformly, controls the sheet thickness, and provides for a smooth surface finish. The sheet thickness tolerances are very tight in the sheet process, with a $\pm 1.0\%$ specification in both the machine and transverse direction. The sheet thickness is monitored at all times with an on-line thickness profiler. The finished sheet 20 is then wound onto large reel carts for transfer to the next process.

II. SHEET PUNCHING

The second stage of the polymer grid production process involves punching a solid sheet 22 with a pattern of holes, prior to its orientation. Specially designed punch tools and heavy duty presses 24 are required. Several hole geometries and punch arrangements are possible, depending upon the finished product properties of the grid, in order to meet the requirements of the ground control application.

III. ORIENTATION

The polymer raw materials used in the manufacture of the grids are selected for their physical properties. However, the very high strength properties of the finished grid are not fully realized until the base polymer's long chain molecules are stretched (oriented) for the mining grid or finished product. This is accomplished in a two stage process.

Initially, the punched sheet is heated to a critical point in the softening range of the polypropylene polymer. Once heated, the sheet is stretched in the machine direction, through a series of heated rollers located within a housing 26. During this uniaxial stretching, polymer is drawn from the junctions into the ribs as the orientation effect passes through the junction zones. This guarantees continuity in molecular orientation in the resultant structure.

In the second stage, the uniaxially oriented grid 28 enters a heated tenter frame (stenter) 30 where the material is stretched in the transverse direction, at right angles to the initial stretch. This biaxial stretch process imparts a high degree of orientation and stretch throughout all regions of the grid.

Exiting the stretching process, the biaxial grid material 32 is quenched (stabilized), and then slip and wound into a roll 34 to meet customer roll dimension requirements.

IV. LAMINATION

A polyester geotextile is bonded to the biaxial grid material by two methods.

Of the two methods for forming the grid composite of polymer grid and geotextile, the flame method exposes both mating surfaces of the polyester geotextile and the polymer grid to an open flame. Immediately thereafter, the two materials are joined together in a nip roll and allowed to cool.

The other method, the heated roll method, is accomplished by running both the polyester geotextile and the polymer grid around a heated roll with the polyester geotextile against the heated roll surface. Upon leaving the heated roll, the composite is run through a nip roll and allowed to cool.

Figure 2:
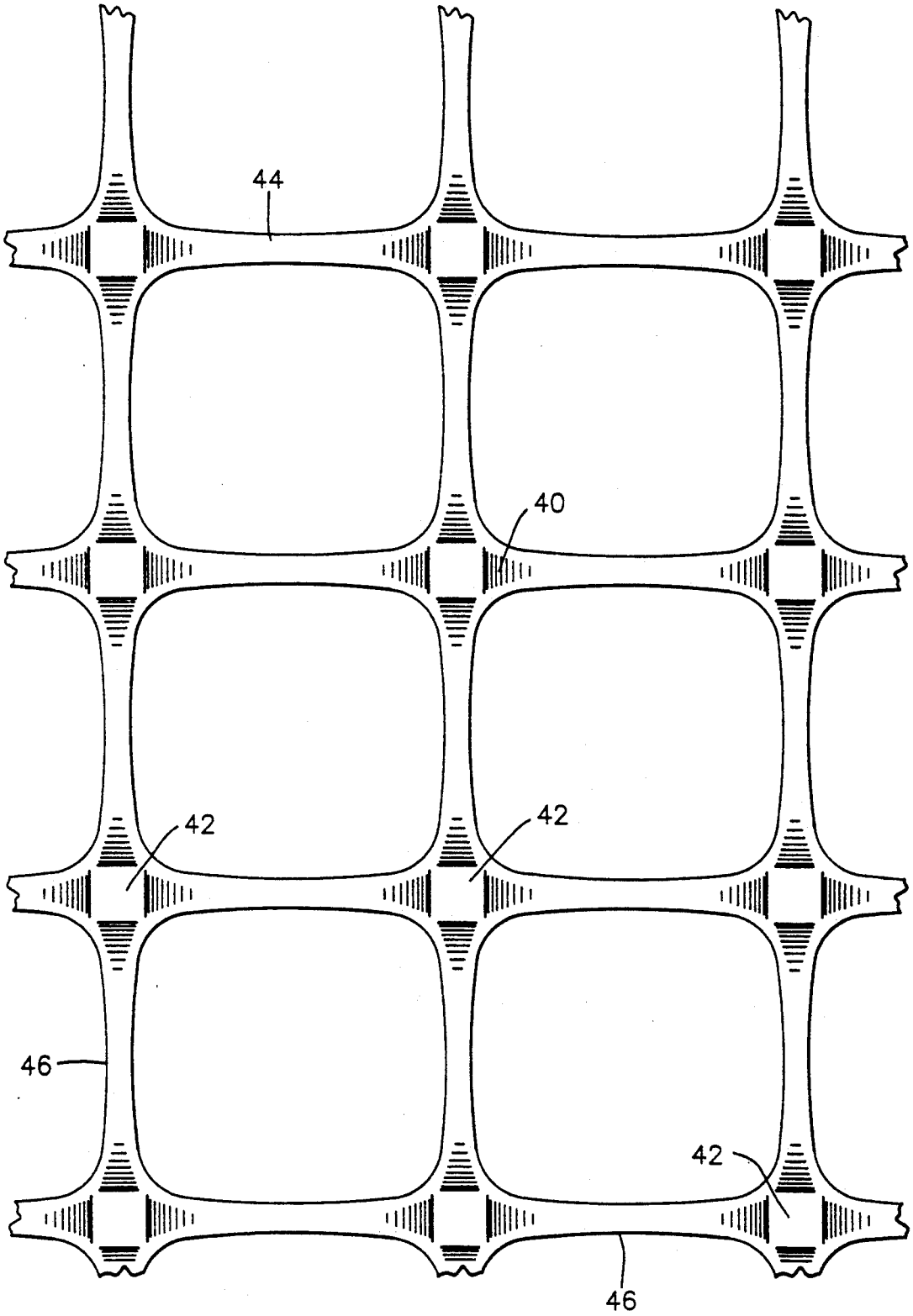
FIG. 2 illustrates a grid composite including a polymer geogrid and a geotextile secured to each other.

As shown in FIG. 2, the polymer geogrid 40, having nodes 42 and ribs 44, is secured across the nodes and ribs 42 to a polyester geotextile 46 by the open flame method. In the heated roll method, only the nodes are bonded to the polyester geotextile.

Figure 3:
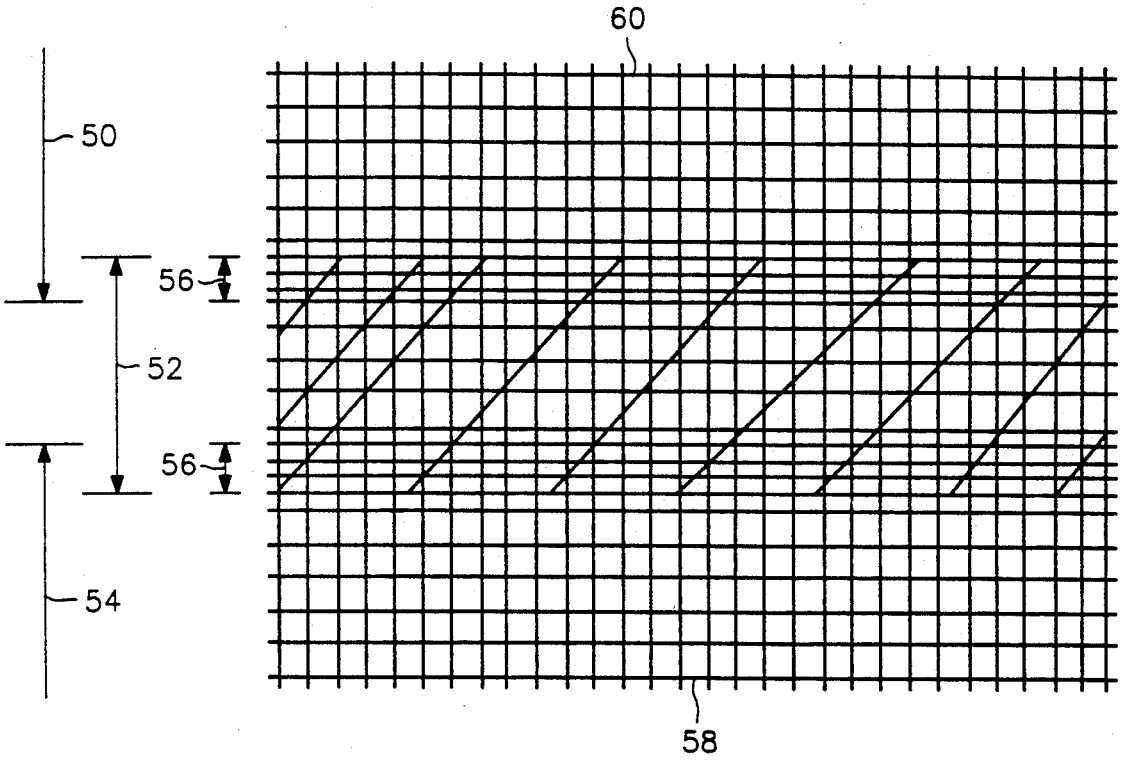
FIG. 3 is a plan view of the terminal portion of a longwall screening package including a section of grid composite secured on or between two lengths of geogrid.

In FIG. 3, three sets of 13 foot wide grid sections are shown each having a length of 200 feet. The first grid section, as indicated by arrow 50, is a polymer geogrid. The second grid section, occupying the space indicated by arrow 52, is a grid composite of the present invention. The third grid section, as indicated by arrow 54 is another polymer geogrid, which is the same as the geogrid indicated by arrow 50. Alternately, the grid composite may be overlaid onto and secured to continuous interconnected sections of polymer geogrid so as to position the grid composite to be arranged over the caving shields of the longwall mining equipment during installation.

At a location above ground, the three sections of grid are overlaid upon one another so that there is a two foot overlap, as indicated by arrows 56, where adjacent sections of grid are secured to one another to avoid the difficult task of joining adjacent sections together at an underground mine site. It is understood that the location of the grid composite section between adjacent sections of polymer grid is provided so that when the longwall shield recovery begins, the grid composite overlays the caving shields to prevent penetration of the gob onto the caving shields. It is also understood that, according to the length of the longwall face, several lateral sections of polymer grid are secured to each other to form the desired length of the longwall face, which is typically between 600 and 1,000 feet.

It is also understood with respect to FIG. 3, that the width of the polymer grid forming one terminal edge 58 of the longwall screening package is of a width so as to locate the grid composite over the caving shields of the longwall mining equipment. It is also understood that the opposite terminal edge 60 of the polymer grid includes several widths of polymer grid sufficient to support the roof of the gob extending rearwardly from the longwall mining equipment.

Once the desired configuration of the longwall screening package is secured to each other by overlapping sections of approximately two feet in width, the screening package is rolled up and folded over for conveyance underground by mining cars. Once underground, the screening package is unfolded and tied along its lateral edges to form a roll of screening 62 which may be hung from shield tips 64 in longwall mining equipment 68. As the longwall mining equipment is advanced, ties along the lateral edges of a screening package are cut to allow the screening package to hang down from the shield tips. During advancement of the shields 66, the unrolled screening package is allowed to extend above the shields 66.

Figure 4:
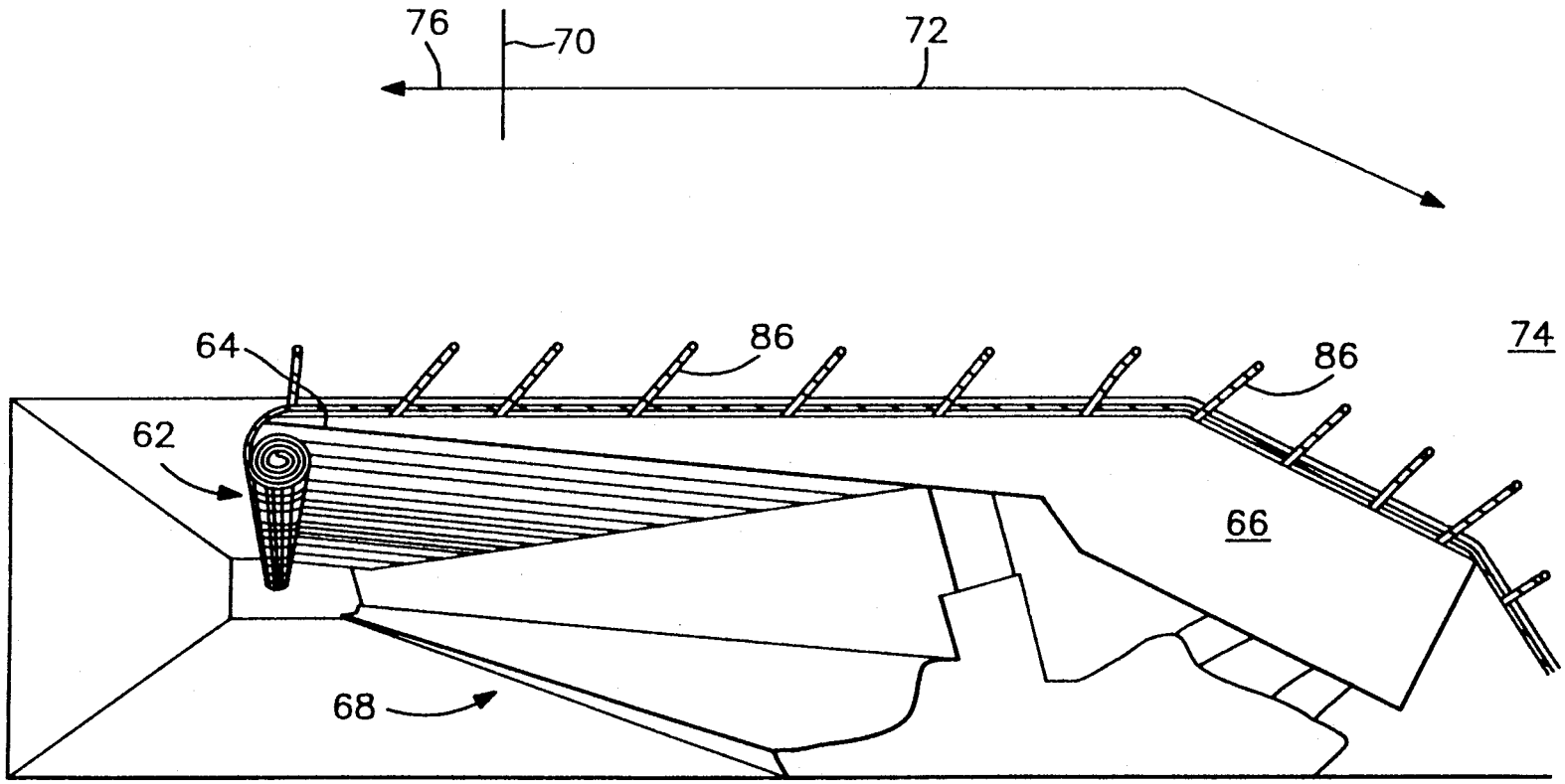
FIG. 4 illustrates a length of geogrid secured to a length of grid composite overhanging the shield tips of longwall mining equipment.

In FIG. 4, advancing longwall mining equipment 68 illustrates, as indicated from junction point 70 and extending in the direction of arrow 72, joined sections of polymer grid located above the longwall mining equipment 68 to temporarily support the gob 74 above the equipment 68. Arrow 76 indicates the initiation of playing out o grid composite which terminates in another section of polymer grid so the grid composite is secured between adjacent sections of polymer grid or on top of continuous interconnected sections of polymer grid. The grid composite is finally located above the shields 66 of the equipment 68 at the terminal portion of the longwall mining process.

Figure 5:
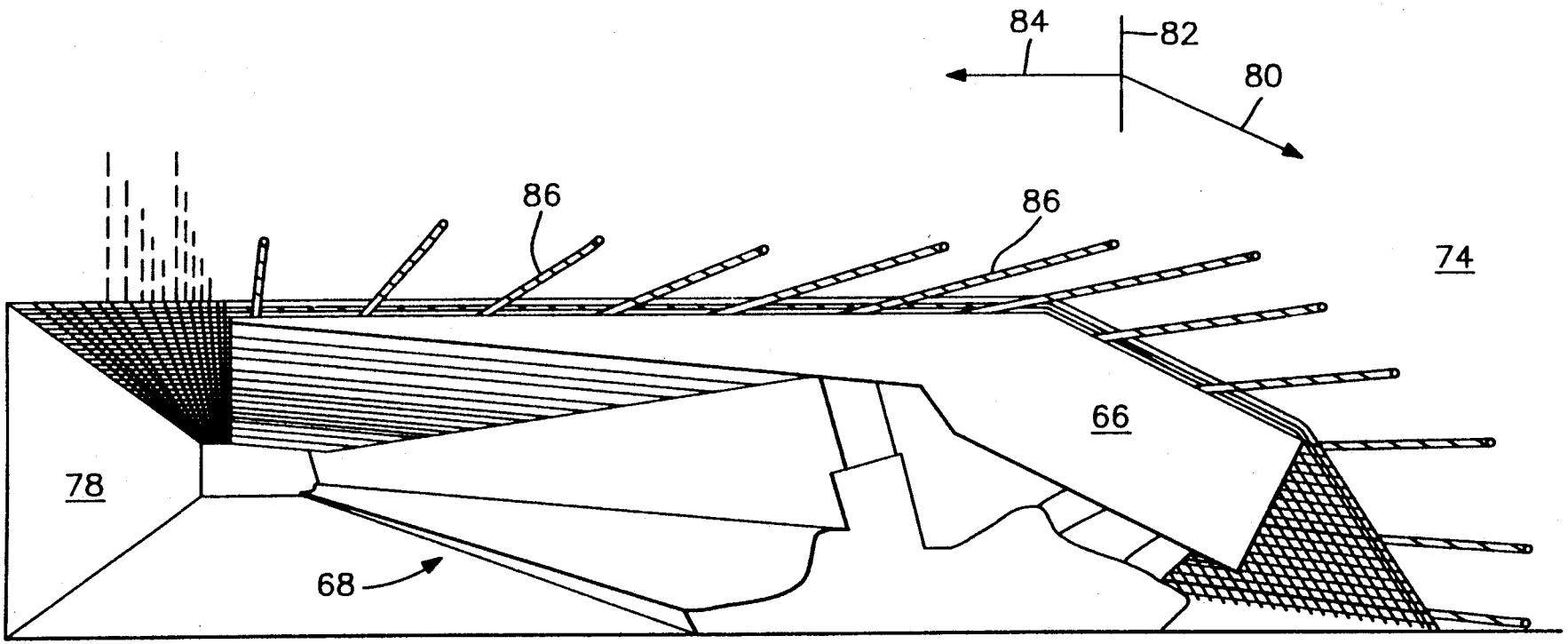
FIG. 5 illustrates a grid composite located over the caving shields of longwall mining equipment to facilitate longwall shield recovery.

In FIG. 5, the longwall mining equipment 68 has advanced to the terminal coal face 78 such that grid composite, as indicated by arrow 80, initiates from a point 82 to extend above the caving shields 66 so as to prevent the gob 74 from penetrating through the grid composite and damaging the mining equipment or injuring workmen during longwall shield recovery. The grid composite indicated by arrow 80 is secured to polymer grid, as indicated by arrow 84, extending from the junction point 82. As previously explained, the polymer grid and grid composite is supported by wire ropes 86, located on 30 inch centers and secured to the mine roof by vertical roof bolts (not shown).

Figure 6:
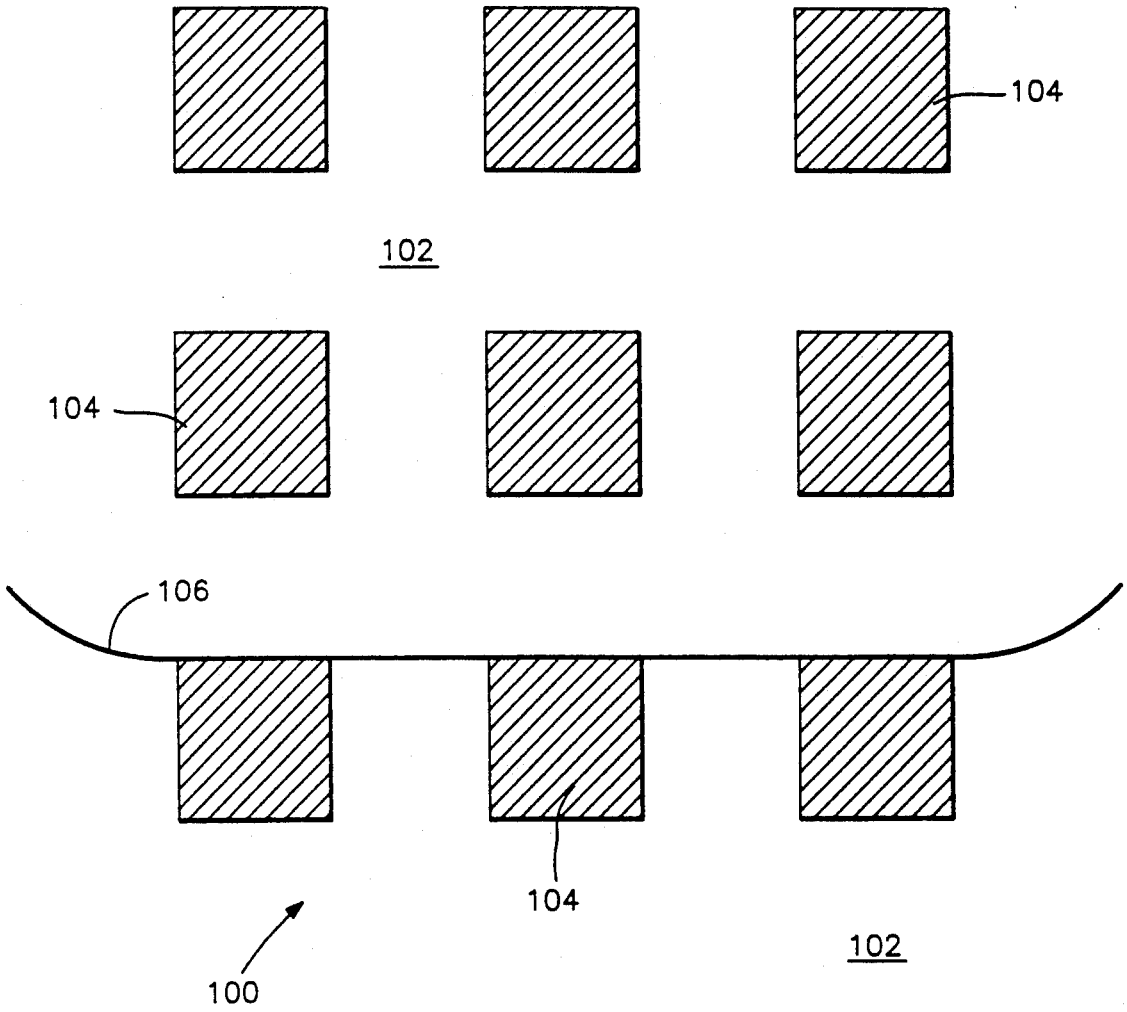
FIG. 6 is a plan view of a backfill barrier used in a room and pillar mining operation.

In FIG. 6, a mine site 100 is shown as is found in a room and pillar mining operation. Typically, excavated portions of the mine 102 are formed between separated pillars 104 which remain after excavation is completed. The pillars 104 consist of unexcavated material and support the roof above the excavated areas 102.

In FIG. 6, a backfill barrier 106 formed of a grid composite 108 is used to separate a waste containment area on one side of the backfill barrier 106 from a filtrate area located on an opposite side of the backfill barrier.

Figure 7:
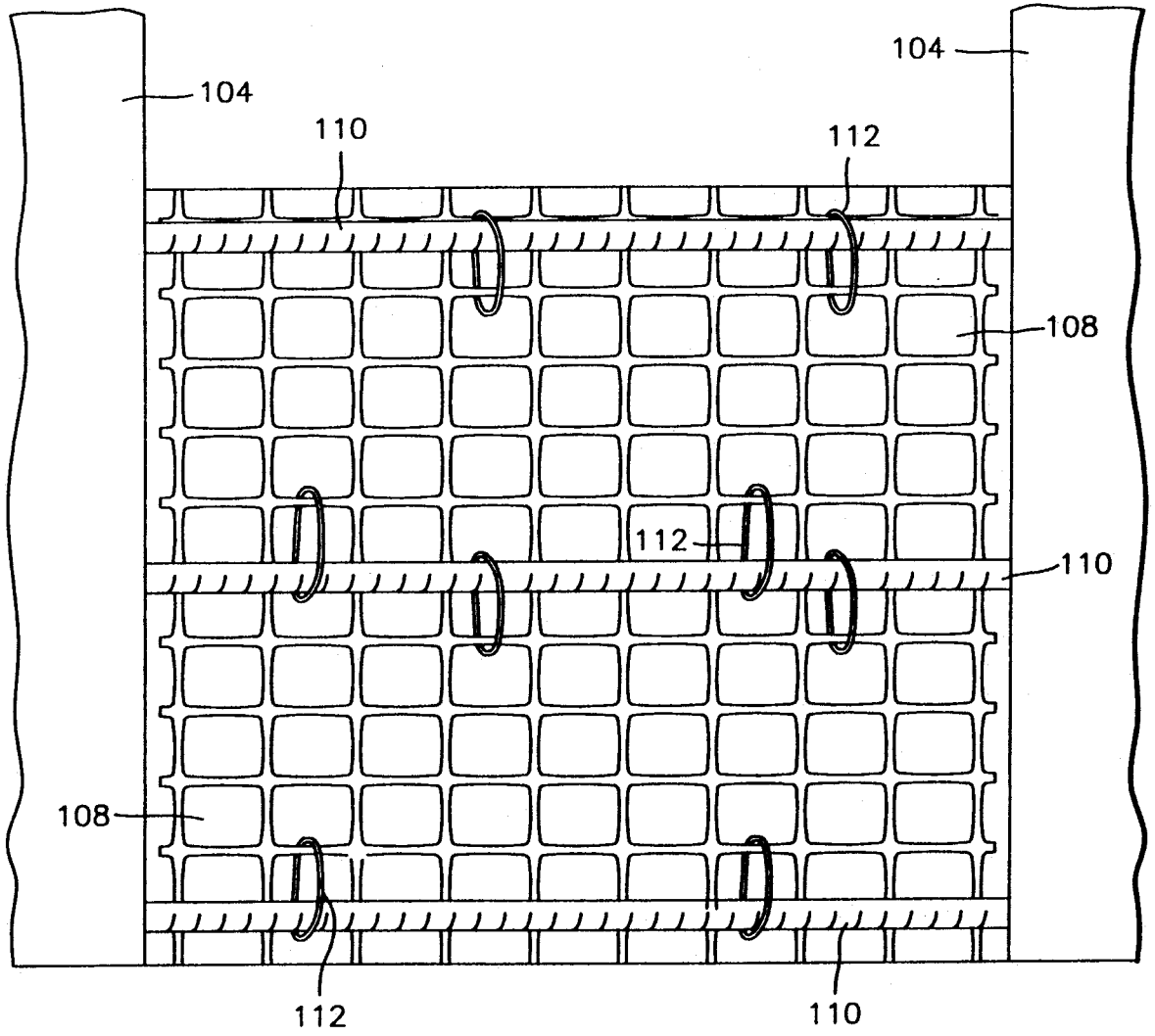
FIG. 7 is a detailed front view of a backfill barrier used in a room and pillar mining operation.

As shown in greater detail in FIG. 7, lengths of wire rope 110 extend between adjacent support pillars 104. Schematically shown are lengths of grid composite 108 secured between stretched sections of wire rope 110 by ties 112. The grid composite 108 is intended to extend completely between adjacent vertically spaced, horizontally extending sections of wire rope 110. Liquids contained in the waste containment area filter through the grid composite by first passing through a polyester geotextile liner 46 secured to the rear face of the structurally supporting polymer geogrid 40. The grid composite filters liquid contained in the waste containment area, allowing only filtered liquid to pass through the backfill barrier 106 while retaining solids in the waste containment area.

Figure 8:
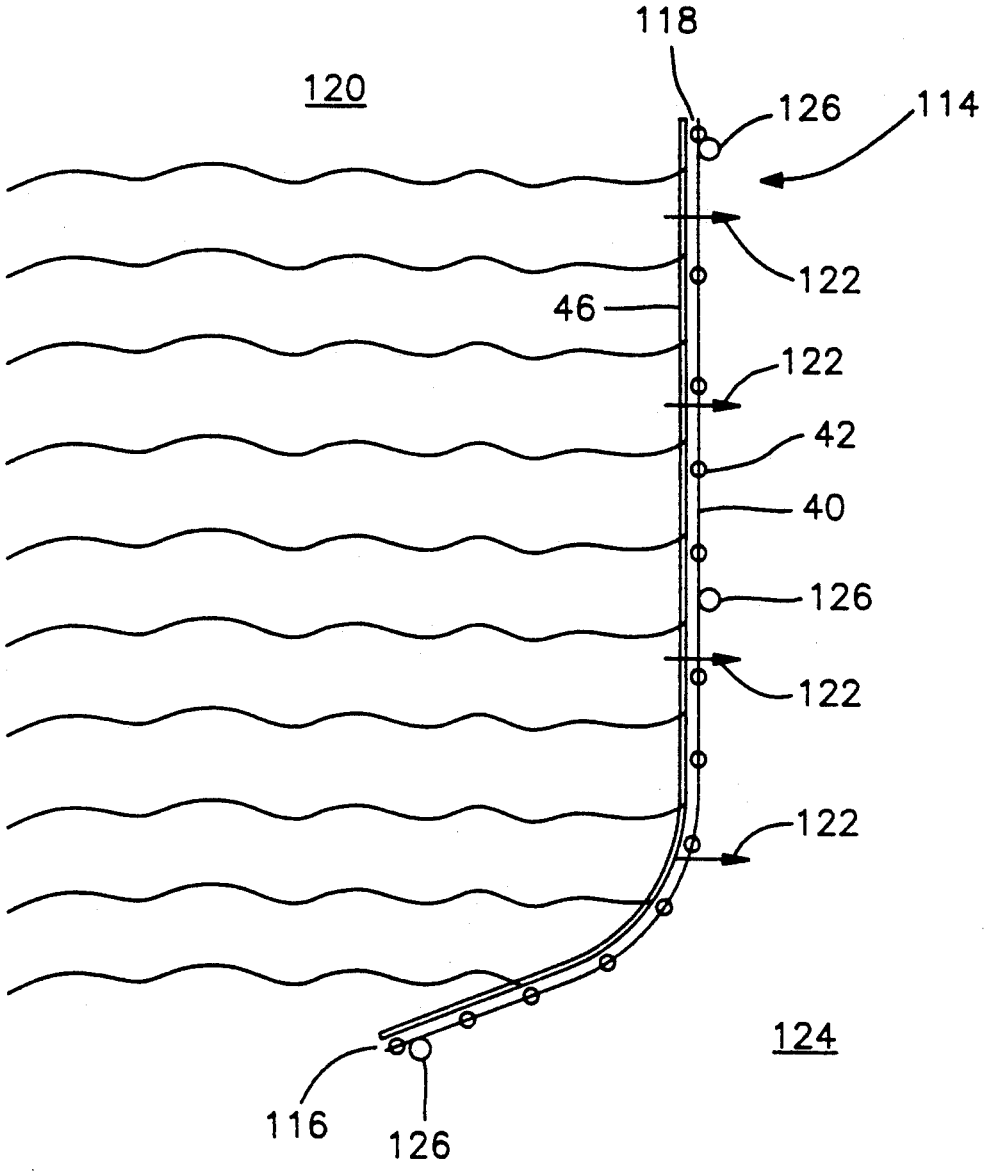
FIG. 8 is a side view of a backfill barrier.

In FIG. 8, a backfill barrier 114 made of a grid composite, as shown in FIG. 2, extends from one end 116 located adjacent to the ground and rises vertically towards an opposite terminal end 118. The backfill barrier 114 includes polymer geogrid 40 with interstitial nodes 42 secured to a polyester geotextile 46 which is located adjacent to a backfill or waste material containment area 120. Decanted water or effulent passes in the direction of arrows 122 into area 124. Horizontally extending wire ropes 126 support backfill barrier 114 for the filtering of backfill or waste material.

Figure 9:
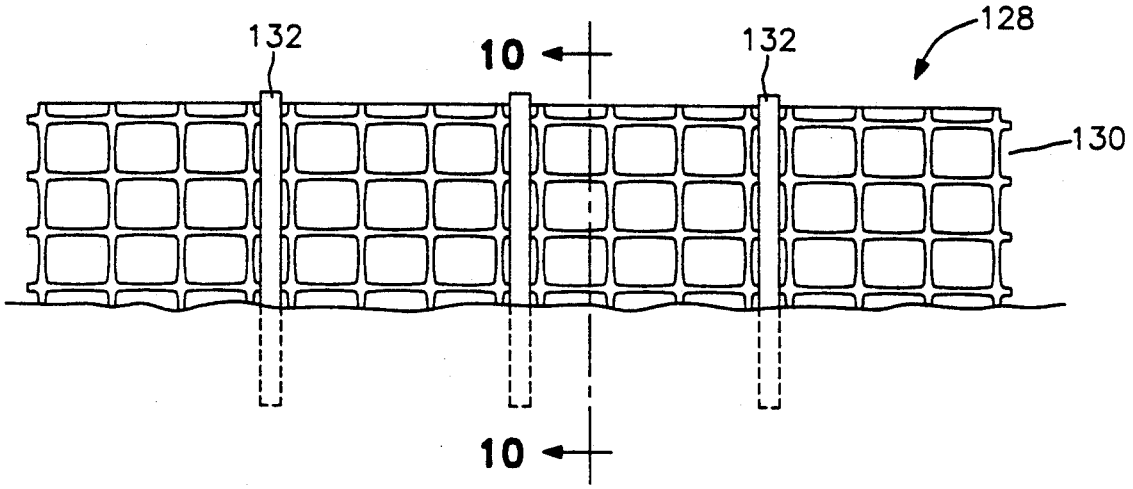
FIG. 9 is a front view of a grid composite used at a construction site.
Figure 10:
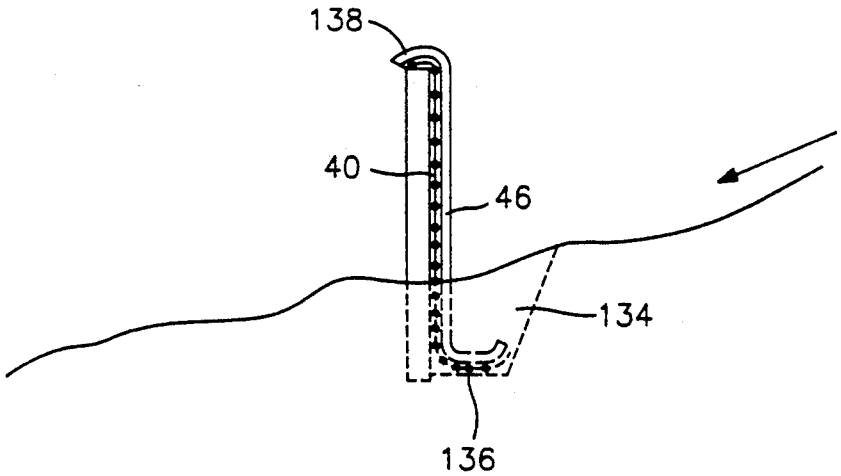
FIG. 10 is a sectional view taken along line 10-10 of FIG. 9.

In a further embodiment of the present invention, as shown in FIGS. 9 and 10, a barrier 128 includes a grid composite 130 including a polyester geotextile 46 secured to a polymer geogrid 40. The grid composite is supported on stakes 132 which are anchored in an anchor trench 134. A portion 136 of the grid composite 130 is located at the bottom of the anchor trench 134 and is folded to form a U-shape. The opposite end 138 of the grid composite 130 is secured to the top of the stakes 132. This arrangement may be used for the filtering of silt or other aqueous solutions, such as, for example, at construction sites.

Having described the invention, many modifications thereto will become apparent to those skilled in the art to which it pertains without deviation from the spirit of the invention as defined by the scope of the appended claims.

I claim:

1. A system for separating liquid from a solution of solids and liquid located in a waste containment area, said system comprising:

an underground mine area formed by a room and pillar mining operation so that a roof of said underground mine area is supported by a plurality of pillars having excavated portions of said underground mine area between said plurality of pillars and having a containment area filled with a solution of solids and liquid in said underground mine area, a grid composite formed of polymer geogrid and a geotextile, and a backfill barrier including said grid composite extending substantially vertically from the ground between adjacent ones of said plurality of pillars and separating said containment area from a filtrate area so that said liquid of said solution is allowed to pass through said geotextile of said grid composite to said filtrate area while said solids are retained in said containment area.

2. A system for separating liquid from a solution of solids and liquid as claimed in claim 1, wherein said geotextile is bonded to said polymer geogrid at nodes of said polymer goegrid.

3. A method of separating liquid from a solution of solids and liquid located in a waste containment area, said method comprising:

forming a grid composite from a polymer geogrid and a geotextile, forming an underground mine by a room and pillar mining operation so that a roof of said underground mine area is supported by a plurality of pillars having excavated portions of said underground mine between said plurality of pillars, positioning said plurality of pillars of said underground mine at a periphery of a waste containment area containing a solution of solids and liquids, securing said grid composite to extend substantially vertically from the ground between said plurality of pillars so as to form a backfill barrier, said backfill barrier separating said containment area from a filtrate area, and filtering liquid from the solution of liquid and solids in said containment area as said liquid passes to said filtrate area through said grid composite.

4. A method of separating liquid from a solution of solids and liquid as claimed in claim 3, wherein said geotextile is bonded to said polymer grid.

5. A method of separating liquid from a solution of solids and liquid as claimed in claim 4, wherein said geotextile is bonded to said polymer grid at nodes of said polymer grid.

6. A system for separating liquid from a solution of solids and liquid in a waste containment area, said system comprising:

a containment area filled with a solution of solids and liquid, a grid composite formed of polymer geogrid and a geotextile, and a backfill barrier including said grid composite extending substantially vertically from the ground and separating said containment area from a filtrate area, a plurality of stakes anchored in a trench and spaced along a peripheral edge of said containment area for supporting said backfill barrier substantially vertically between adjacent stakes so that said liquid of said solution is allowed to pass through said geotextile of said grid composite to said filtrate area while said solids are retained in said containment area.

7. A system for separating liquid from a solution of solids and liquid as claimed in claim 6, wherein said geotextile is bonded to said polymer geogrid at nodes of said polymer geogrid.

8. A system for separating liquid from a solution of solids and liquid as claimed in claim 6, wherein a lowermost end of said backfill barrier is buried in said trench.

9. A method of separating liquid from a solution of solids and liquid located in a waste containment area, said method comprising:

forming a grid composite from a polymer geogrid and a geotextile, arranging a plurality of stakes anchored in a trench at a periphery of a containment area containing a solution of solids and liquids, securing said grid composite to extend substantially vertically from the group between said plurality of stakes so as to form a backfill barrier, said backfill barrier separating said containment area from a filtrate area, and filtering liquid from the solution of liquid and solids in said containment area as said liquid passes to said filtrate area through said grid composite.

10. A method of separating liquid from a solution of solids and liquid as claimed in claim 9, wherein said geotextile is bonded to said polymer grid.

11. A method of separating liquid from a solution of solids and liquid as claimed in claim 10, wherein said geotextile is bonded to said polymer grid at nodes of said polymer grid.

12. A method of separating liquid from a solution of solids and liquid as claimed in claim 9, wherein a lowermost end of said backfill barrier is buried in said trench.

13. A system for separating liquid from a solution of solids and liquid located in a waste containment area, said system comprising:

a containment area filled with a solution of solids and liquid, a grid composite formed of polymer geogrid and a geotextile, a backfill barrier including said grid composite extending substantially vertically from the ground and separating said containment area from a filtrate area, and a plurality of substantially horizontally oriented cables spaced vertically along a peripheral edge of said containment area for supporting said backfill barrier substantially vertically between adjacent ones of said substantially horizontally oriented cables so that said liquid of said solution is allowed to pass through said geotextile of said grid composite to said filtrate area while said solids are retained in said containment area.

14. A system for separating liquid from a solution of solids and liquid as claimed in claim 13, wherein said geotextile is bonded to said polymer geogrid at nodes of said polymer geogrid.

15. A method of separating liquid from a solution of solids and liquid located in a waste containment area, said method comprising:

forming a grid composite from a polymer geogrid and a geotextile, arranging a plurality of substantially horizontally oriented cables at a periphery of a containment area containing a solution of solids and liquids, securing said grid composite to said plurality of substantially horizontally oriented cables so as to form a backfill barrier extending substantially vertically from the ground and between said plurality of substantially horizontally oriented cables, said backfill barrier separating said containment area from a filtrate area, and filtering liquid from the solution of liquid and solids in said containment area as said liquid passes to said filtrate area through said grid composite.

16. A method of separating liquid from a solution of solids and liquid as claimed in claim 15, wherein said geotextile is bonded to said polymer grid.

17. A method of separating liquid from a solution of solids and liquid as claimed in claim 16, wherein said geotextile is bonded to said polymer grid at nodes of said polymer grid supports includes stakes.

* * * * *